United States Patent [19]

Korcz

[11] Patent Number: 4,854,110

[45] Date of Patent: Aug. 8, 1989

[54] AUTO SEALING PRESSURE CONTAINER

[75] Inventor: William H. Korcz, Houston, Tex.

[73] Assignee: Shell Oil Company, Houston, Tex.

[21] Appl. No.: 167,760

[22] Filed: Mar. 14, 1988

[51] Int. Cl.[4] ..... B65B 3/02

[52] U.S. Cl. ..... 53/452; 53/264; 53/330; 53/489

[58] Field of Search ..... 53/452, 484, 485, 486, 53/489, 264, 329, 330

[56] References Cited

U.S. PATENT DOCUMENTS

| | | |
|---|---|---|
| 41,440 | 2/1864 | Matthews, Jr. . |
| 225,475 | 3/1880 | Hutchinson . |
| 280,234 | 6/1883 | Pearson . |
| 503,094 | 8/1893 | Mack . |
| 1,726,111 | 8/1929 | Loewe . |

*Primary Examiner*—John Sipos

[57] ABSTRACT

A method for the design of a pressure vessel which incorporates two ends of a straight wall cylinder which are capped and sealed to form a container capable of holding the vessel contents under pressure. This method is applicable to metal as well as non-metal vessels and to vessels having unusual shapes or combinations of such geometries, such as square, oval, triangular, complex and irregular curves or combinations. The vessel may be made on a continuous basis from endless lengths of vessel stock continuously cut to length. This method of making the pressure container for food or beverage packaging comprises the steps of fabricating a vessel, cutting the vessel to desired length, placing a means of support in the bottom of the vessel, applying a sealant material to the means of support to form a sealant bed at the bottom of the vessel, placing a bottom end onto the sealant bed within the vessel, placing a top end onto the bottom end within the vessel, where the top end contains at least a small amount of the magnetic material, placing a second means of support at the top of the vessel, applying a sealant material to the means of support to form a sealant bed at the top of the vessel, filling with vessel with contents, and drawing the top end to a position contiguous to the sealant bed at the top of the vessel by a magnetic means and sealing said vessel.

8 Claims, 5 Drawing Sheets

FIG. 1
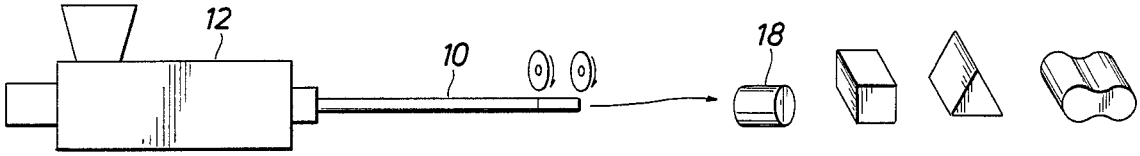
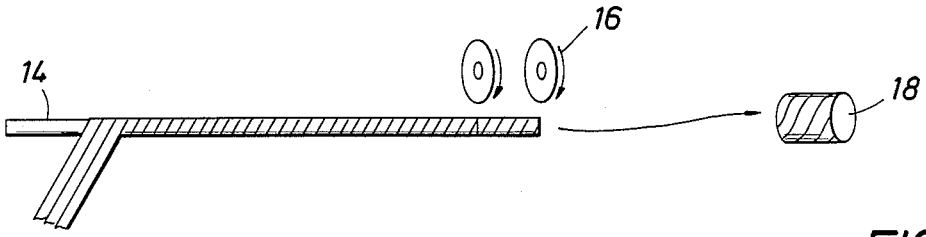
FIG. 2
FIG. 3
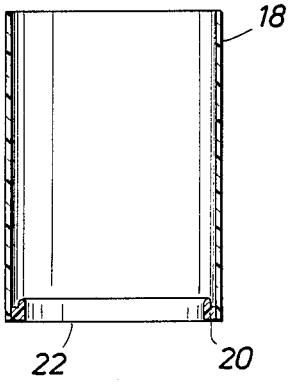
FIG. 3A
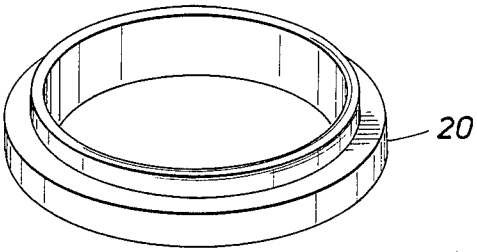
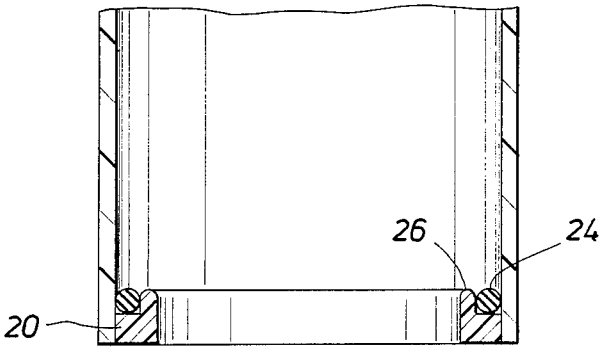
FIG. 4

FIG. 5A
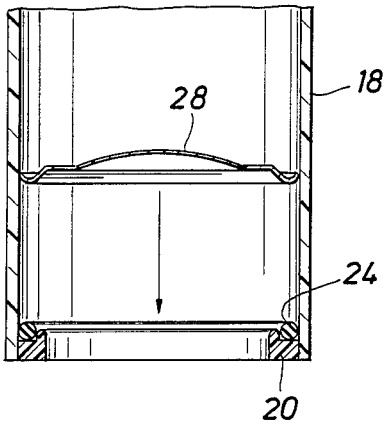
FIG. 5B
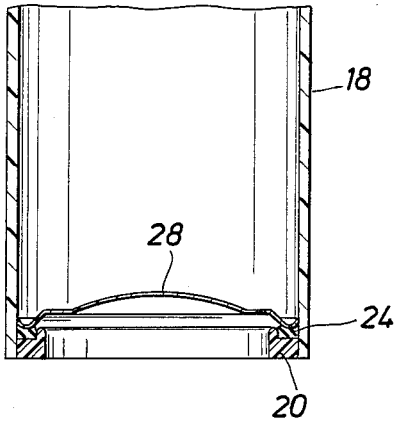
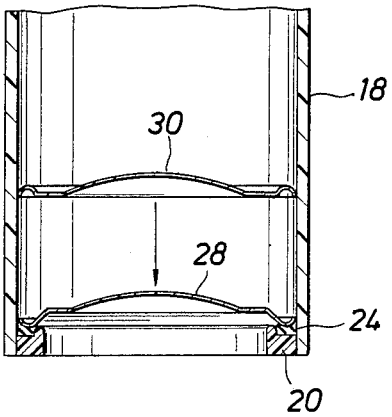
FIG. 6
FIG. 7
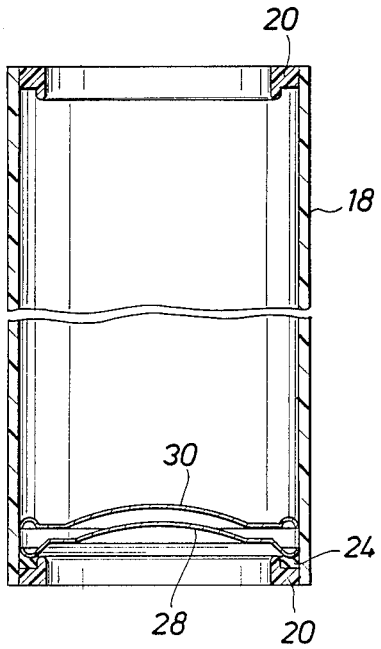
FIG. 8
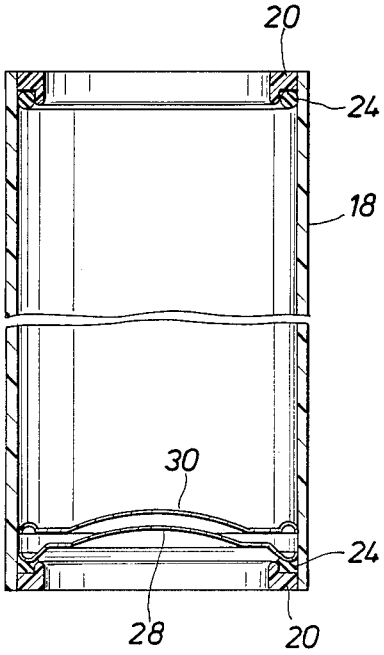

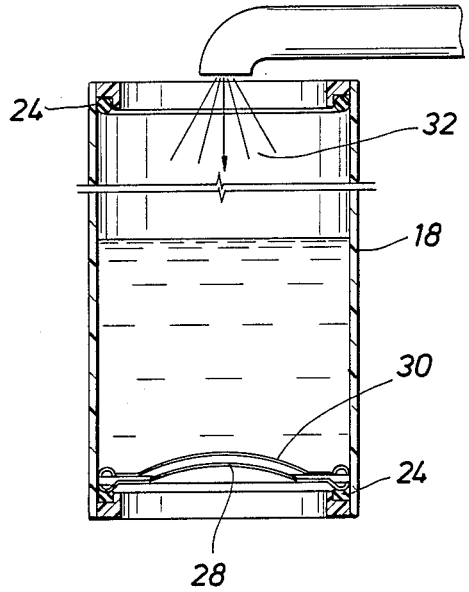
FIG. 9
FIG. 10A
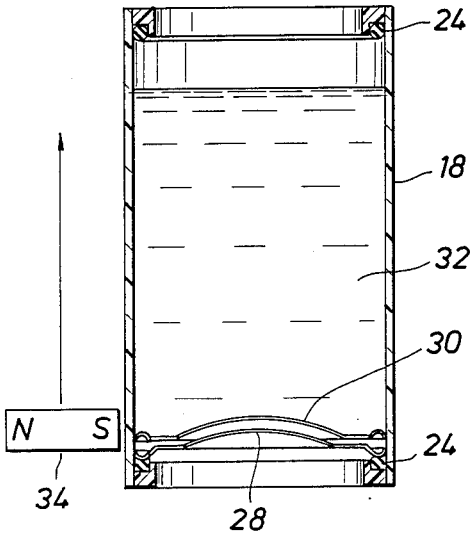
FIG. 10B
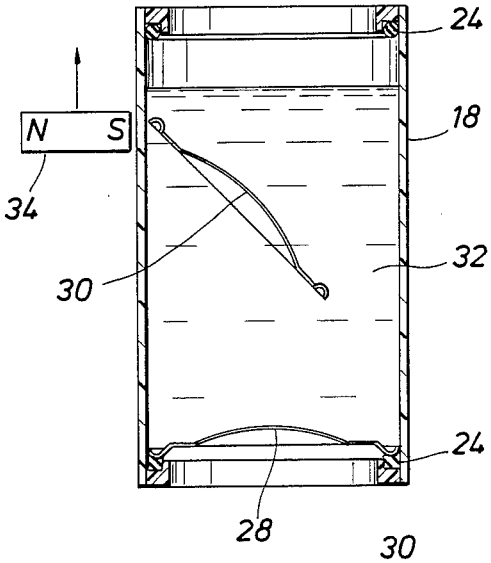
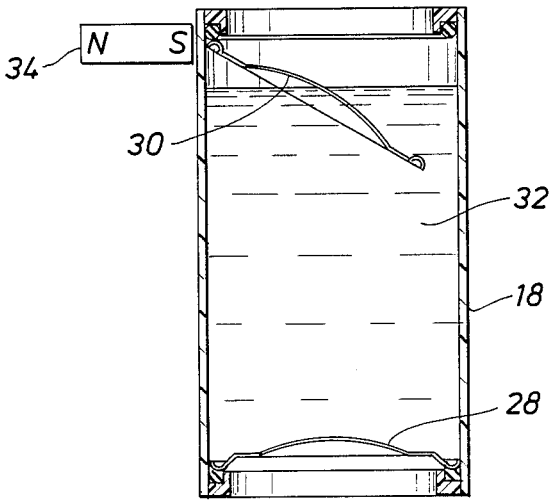
FIG. 10C
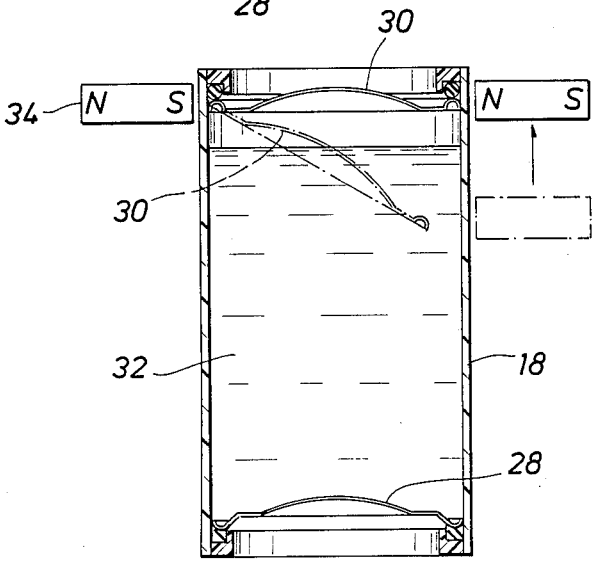
FIG. 10D FIG. 15A
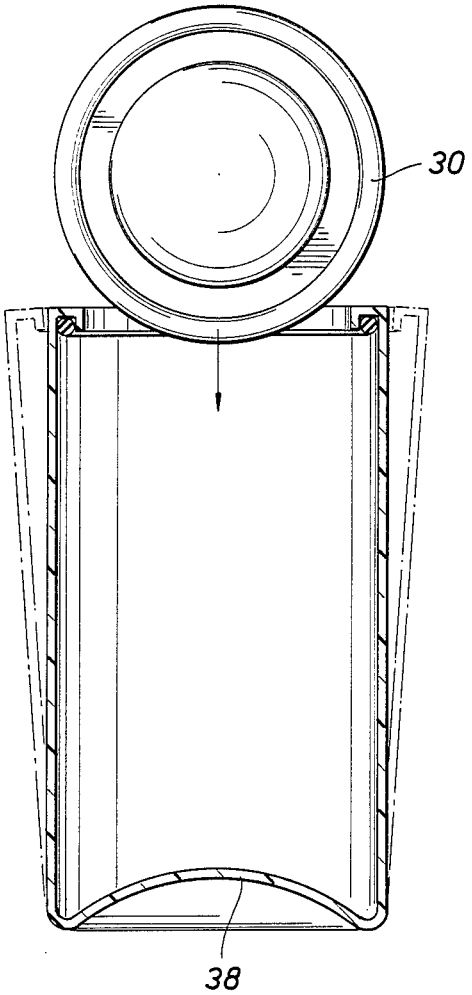
FIG. 15B
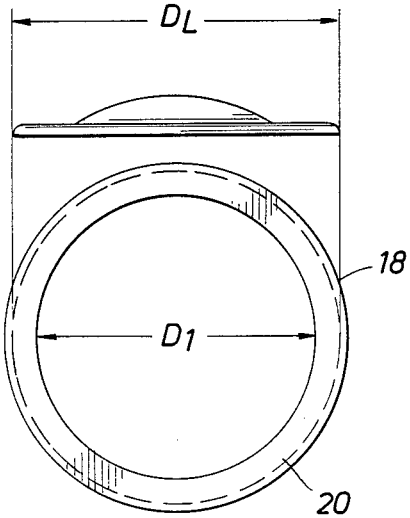
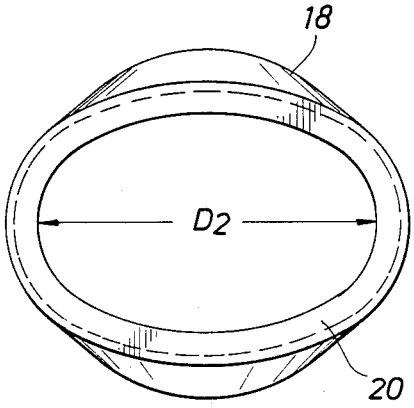
FIG. 15C

AUTO SEALING PRESSURE CONTAINER

OBJECT OF THE INVENTION

The object of the present invention is the formation of a pressure vessel that incorporates a novel method by which the two ends of a straight wall cylinder are capped and sealed to form a container capable of holding the vessel contents under pressure. This mechanical design and novel method of capping and sealing is applicable to vessels having unusual shapes, for example, square, oval, triangular, complex, and irregular curves or combinations of such geometries.

Heretofore, capping and sealing of non-cylindrical geometries could not be done by the typical screw-type closure found in use for glass, metal and plastic jars, cans and bottles. The ends of the vessel in these cases must present a circle configuration for a screw-type closure in order to allow closing and opening. In the case of mechanical double-seaming, use of irregular end geometrics (non-circular or oval) are difficult, if not impossible, to achieve. Oftentimes, the vessel body must be mechanically double-seamed, necessitating a flanging of the vessel body in order to accept the vessel lid. However, certain plastic sidewall vessels are difficult to flange. Oftentimes, it is desirable to make a vessel of a particular material that is impossible to flange and mechanically double seam, such as extremely stiff and/or brittle materials like highly filler-loaded plastics. In the past, such materials had to be bypassed for different materials which could be flanged and mechanically double seamed. Oftentimes, it is desired to have a vessel which can be made on a continuous basis from an endless length of vessel stock which is continuously cut to length. However, the molding or forming of flanges cannot be accomplished on a continuous basis.

SUMMARY OF THE INVENTION

Applicant has discovered a method for the design of a pressure vessel which incorporates two ends of a straight wall cylinder which are capped and sealed to form a container capable of holding the vessel contents under pressure. The method is applicable to metal as well as non-metal cylinders and is applicable to vessels having unusual shapes or combinations of such geometries such as square, oval, triangular, complex and irregular curves or combinations of such profile geometries. This mechanical design and novel method eliminates the necessity of flanging the vessel body to accept the lid, which is usually necessary for mechanical doubleseaming to form a closure. This design and method is especially suited to plastic sidewall vessels that are difficult to flange and provides a means for capping and sealing vessels made of materials that are impossible to flange and mechanically double seam, such as highly filler-loaded plastics. In addition, this mechanical design and method will allow for vessels made on a continuous basis from endless lengths of vessel stock continuously cut to length.

DESCRIPTION OF THE DRAWINGS

FIGS. 1 and 2 show the method by which a plastic tube or vessel may be fabricated by extrusion or fixed mandrel winding.

FIGS. 3 and 3A show the first annular boss retainer ring and its position in the vessel.

FIG. 4 shows sealant material which is placed on top of the annular boss ring.

FIGS. 5 and 6 show the placement of the bottom and top end lids within the vessel.

FIGS. 7 and 8 show the formation of the second annular boss retaining ring and sealant lid within the vessel.

FIG. 9 shows the filling of the vessel with appropriate contents.

FIGS. 10A through D show the use of magnets to draw the top end lid up through the contents of the vessel into proper placement at the top of the vessel.

FIG. 15*a* shows the placement of top lid in position deformation operation on a vessel with a concave bottom.

FIG. 15*b* and *c* show a top view of the lid in relation to the diameter of the lid and the diameter within the molded end and annular ring and the diameter of the space within the molded annular ring upon deformation.

DETAILED DESCRIPTION OF THE INVENTION

Figure 11:
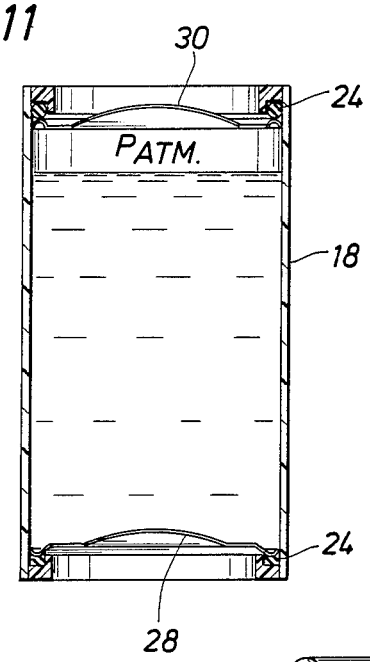
FIGS. 11 and 12 show the vessel with liquid contents under pressure and the vessel ends which have all but sealed themselves into the sealant bed.

In FIGS. 1 and 2, a plastic tube or vessel 10 is fabricated by any number of continuous processes, for example, extrusion for all geometries or fixed mandrel winding as practiced in making cylindrical tubes on a continuous basis. Paper oil cans can be made by making cylindrical tubes by fixed mandrel winding. The plastic tube that is extruded by extruded 12 or a fixed mandrel 14 is cut to the length desired by cutter 16 which is usually in line as part of the continuous fabrication process to produce cut vessel 18.

FIGS. 3 and 3A show the first annular "boss" retainer ring and the positioning of such ring within the bottom 22 of the vessel 18. The "boss" 20 is in the form of a ledge on a plastic tube or vessel perimeter and is attached inside one end of the vessel 18 as a separate part. This "boss" 20 serves as an annular retainer ring for the perimeter of the bottom end/lid of the pressure vessel 18. The "boss" 20 can be bonded to the end of the vessel 18 by various means, including adhesives and/or heat. Examples of heat bonding include systems such as ultrasonic, spin welding where the vessel is cylindrical, induction heating, etc. The exact design size dimensions and material chosen for the annular "boss" 20 will depend upon the nature of the plastic tube or vessel 18, the pressure expected to be encountered by the vessel, the contents of the vessel, etc.

In FIG. 4, a sealant or gasket material 24 is applied as an integral component of the "boss" 20 or ledge to form a bed. The sealant or gasket material 24 is applied in the form of an "O" ring on the upper portion 26 of the "boss" 20. The sealant, gasket or O-ring 24 functions to hold and initially position the bottom end/lid perimeter in place. It may be compliant and may have some tack, and also will function to seal the bottom end/lid in place when the container is pressurized. The sealant 24 may already by part of the annular "boss" 20 prior to the attachment of the annular "boss" 20 or may be applied in a separate operation after the annular "boss" 20 is attached, for example by hot melt spray. There are various well known means of attaching the sealant 24.

FIG. 5A shows a bottom end/lid 28 which is placed in the vessel 18 and pressure-pulled or pressure pushed by a variety of means into the bed of sealant 24 at its perimeter. The perimeter of lid 28 is designed so that the edge rests and locks into the sealant 24 as in FIG. 5B. FIG. 6 shows the top lid 30 which is placed in the vessel 18 lying atop the bottom lid 28. The top lid 30 has at least a small amount of a magnetic material as a component in it, preferably iron or steel. FIGS. 7 and 8 shows the formation of the second annular "boss" retainer ring 20 and bed of sealant 24 at the opposite end of the plastic tube or vessel 18. The vessel 18, with lids 28 and 30 shown in FIG. 8, is now ready for filling. In FIG. 9, the vessel 18 is filled with contents 32 capable of generating pressure when the vessel 18 is closed.

In FIG. 10, a magnet 34 or several magnets draw up the top end lid 30 containing the magnetic material through the contents 32 of vessel 18 to the top annular "boss" 20 of vessel 18. It may be preferable to do this in such a manner to ensure that the top end lid 30 is skewed when raising it to allow free passage of the top end/lid 30 through the contents 32 of the vessel 18. This may be seen in FIGS. 10A through 10D. Alternatively, a magnet on a mechanical arm or rod can be immersed in the contents 32 inside the vessel 18 and lowered to contact the metal containing lid 30 and then raised to raise the lid 30 to the top position.

Figure 12:
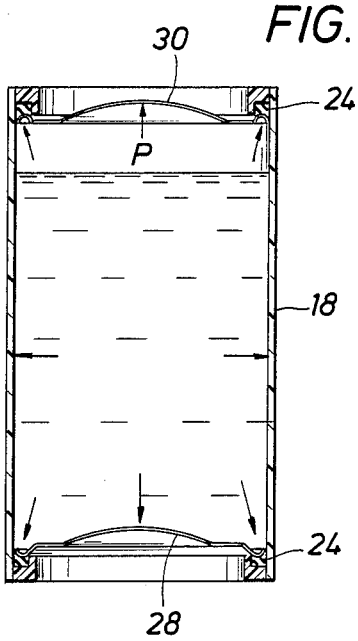

In FIG. 11, the top end lid 30 is held in place via capillary forces of any liquid contents 32 present and/or the bed of sealant bed material 24. FIG. 12 shows vessel ends 28 and 30 which have auto sealed into the bed of sealant 24 of annular "boss" retainers 20 under the pressure developed by the contents of the vessel 18 once the vessel 18 is closed by raising the top end lid 30 into position.

Figure 13:
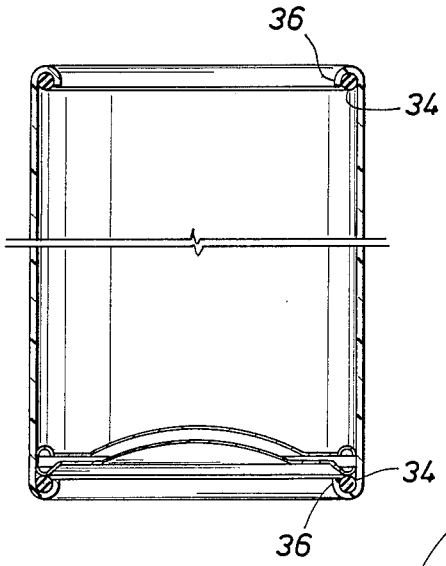
FIG. 13 shows inward bottom and top flanges which may be desired.

This method of auto sealing is not limited to plastic tubes, but to any vessel 18 where an annular "boss" retainers 20 can be easily fabricated via sequential flanging and loading. For example, metal containers in cylindrical or oval geometry can be made as shown in FIG. 13. FIG. 13 shows inward bottom and top flanges 34 and 36 are made sequentially by first:

(1) making bottom flanges 34 and then,
(2) loading the lids, and finally
(3) making the top flange 36.

Figure 14:
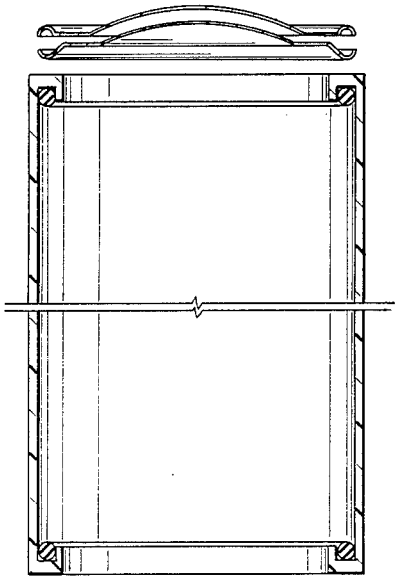
FIGS. 14, 14A and 14B show an introduction of the lids into the vessel after formation of the vessel by deformation of the vessel.
Figure 14A:
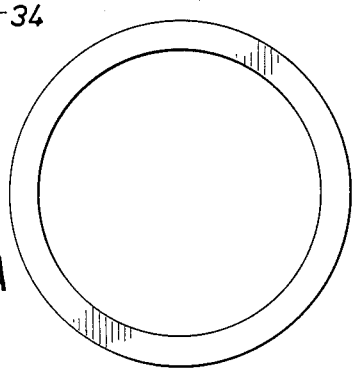
Figure 14B:
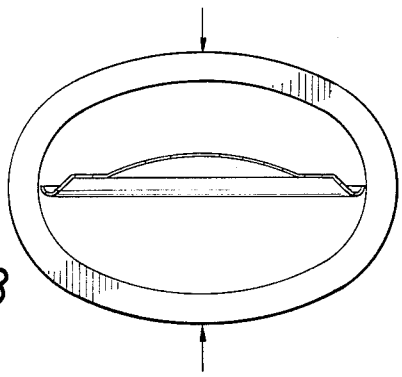

If it is desired to form a vessel 18 which contains annular "bosses" 20 within the forming step, the introduction of lids 28 and 30 into the vessel after formation is difficult unless the vessel 18 can be deformed as seen in FIG. 14A and 14B. Pre-loading of one end/lid 28 or 30 or two end lids 28 and 30 is virtually impossible, especially for vessels having square, rectangular, or other such perimeter geometries.

However, FIGS. 15A, B and C show the introduction of the top lid 30 in post deformation operation wherein the top portion of the vessel 18 and the annular "boss" 20 can be flattened in an oblong shape to allow insertion of the top lid 30 into the vessel 18. This illustrates the use of an annular "boss" 20 and a concave bottom 38. FIG. 15A and 15B show the top view of the top lid 30, the diameter of which is referred to as $D_L$, the vessel body 18 and molded end annular ring 20. The inside diameter of the molded end annular ring 20 is referred to as $D_1$. Upon deformation, the effective diameter of the molded annular ring becomes $D_2$. If the diameter of lid 30 is $D_L$, then $D_L$ is greater than $D_1$ and the lid cannot be inserted. However, when $D_L$ is less than $D_2$, thus allowing for insertion of the lid 30 upon deformation, lid 30 can be inserted. Thus, for those vessel geometries that can be suitably deformed to allow insertion of the top lid, the necessity of forming the second annular ring after insertion of both the bottom and top lid in the vessel may not be preferred. In any case, the magnetic closing system is invoked for this example as well.

What is claimed in the invention:

1. A method of making a pressure container for food or beverage packaging which comprises the steps of:
- fabricating a vessel;
- cutting said vessel to a desired length;
- placing a means of end cap support in the bottom of said vessel;
- applying a sealant material to said means of support to form a sealant bed at the bottom of said vessel;
- placing a bottom end onto said sealant bed within said vessel;
- placing a top end onto said bottom end within said vessel, said top end containing at least a small amount of a magnetic material;
- placing a second means of support at the top of said vessel;
- applying a sealant material to said second means of support to form a sealant bed at the top of said vessel;
- filling said vessel with contents; and
- drawing said top end to a position contiguous to said sealant bed at the top of said vessel by magnetic means, and sealing said vessel.

2. The method of claim 1 wherein the means of support which is placed in the bottom of said vessel is an annular boss retainer ring.

3. The method of claim 1 wherein said sealant material is applied in the form of an O-ring on the upper portion of the means of support in the bottom of said vessel.

4. The method of claim 1 wherein said top lid contains at least a partial amount of iron or steel.

5. The method of claim 1 wherein a magnet is used on the outside of said container to draw up said top end lid through said contents of said vessel and wherein said top end lid is skewed when so drawing said lid.

6. The method of claim 1 wherein said magnet is immersed in said contents of said vessel onto the metal containing lid and is raised via a mechanical arm or rod.

7. A method of making a pressure container for food or beverage packaging which comprises the steps of:
- fabricating a vessel which contains a means of support in the bottom and top of said vessel;
- applying a sealant material to said means of support to form a sealant bed at the bottom and top of said vessel;
- deforming the top diameter of said vessel which placing a bottom end into said vessel onto said bottom sealant bed within said vessel;
- placing a top end onto said bottom end within said vessel, said top end containing at least a small amount of a magnetic material;
- filling said vessel with contents; and
- drawing said top end to a position contiguous to said sealant bed at the top of said vessel by magnetic means and sealing said vessel.

8. A method of making a pressure container for food or beverage packaging which comprises the steps of:

fabricating a vessel;

cutting said vessel to a desired length;

placing an annular boss retainer ring in the bottom of said vessel;

applying a sealant O-ring material to said retainer ring to form a sealant bed at the bottom of said vessel;

placing a bottom end onto said sealant bed within said vessel;

placing a top end onto said bottom end within said vessel said top end containing at least a small amount of iron or steel, placing an annular boss retainer ring at the top of said vessel;

applying an O-ring sealant material to said retainer ring to form a sealant bed at the top of said vessel;

filling said vessel with contents; and drawing said top end to a position contiguous to said O-ring sealant bed at the top of said vessel by magnetic means and sealing said vessel.

* * * * *